US007464568B2

(12) United States Patent
Le Bot et al.

(10) Patent No.: US 7,464,568 B2
(45) Date of Patent: Dec. 16, 2008

(54) CRYOGENIC DISTILLATION METHOD AND SYSTEM FOR AIR SEPARATION

(75) Inventors: Patrick Le Bot, Vincennes (FR); Olivier De Cayeux, Paris (FR)

(73) Assignee: L'Air Liquide, Societe Anonyme A Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 256 days.

(21) Appl. No.: 10/555,765

(22) PCT Filed: Mar. 24, 2004

(86) PCT No.: PCT/FR2004/050122

§ 371 (c)(1),
(2), (4) Date: Nov. 4, 2005

(87) PCT Pub. No.: WO2004/099690

PCT Pub. Date: Nov. 18, 2004

(65) Prior Publication Data

US 2007/0017251 A1 Jan. 25, 2007

(51) Int. Cl.
*F25J 3/00* (2006.01)

(52) U.S. Cl. ..... 62/646; 62/653; 62/654

(58) Field of Classification Search ..... 62/646, 62/645, 653, 654, 643
See application file for complete search history.

(56) References Cited

U.S. PATENT DOCUMENTS

| | | | | |
|---|---|---|---|---|
| 4,072,023 | A | 2/1978 | Springmann | |
| 4,662,917 | A * | 5/1987 | Cormier et al. | 62/646 |
| 5,329,776 | A * | 7/1994 | Grenier | 62/646 |
| 5,345,773 | A * | 9/1994 | Nagamura et al. | 62/646 |
| 5,379,598 | A * | 1/1995 | Mostello | 62/646 |
| 5,412,954 | A * | 5/1995 | Grenier | 62/646 |
| 5,475,980 | A | 12/1995 | Grenier et al. | |
| 6,185,960 | B1 * | 2/2001 | Voit | 62/656 |
| 6,257,020 | B1 | 7/2001 | Tranier | |
| 2004/0221612 | A1 | 11/2004 | Jaouani et al. | |

FOREIGN PATENT DOCUMENTS

| | | |
|---|---|---|
| DE | 199 51 521 | 5/2001 |

(Continued)

OTHER PUBLICATIONS

International Search Report for PCT/FR2004/050122.

*Primary Examiner*—William C Doerrler
(74) *Attorney, Agent, or Firm*—Elwood Haynes

(57) ABSTRACT

Methods and apparatus for air separation by cryogenic distillation in a double or triple air separation column. The column in the system with the highest operating pressure is said to be operating at medium pressure. All the air to be distilled is pressurized to a high pressure, which is about 5 bar greater than the medium pressure. The air is purified at this high pressure, and a portion of the purified air is cooled in a heat exchange line, while another portion is expanded in a turbine. Part of the cooled air is drawn from the exchange line with a cold booster, which is mechanically coupled to at least one turbine. An energy dissipation device is also provided which is coupled to the turbine not coupled to the cold booster. The energy dissipation device is either another booster, an oil break system, or an electrical generator.

7 Claims, 3 Drawing Sheets

FOREIGN PATENT DOCUMENTS

| | | |
|---|---|---|
| EP | 0 504 029 | 9/1992 |
| EP | 0 644 388 | 3/1995 |
| EP | 1 014 020 | 6/2000 |
| FR | 2 688 052 | 9/1993 |
| FR | 03 01722 | 2/2003 |

* cited by examiner

CRYOGENIC DISTILLATION METHOD AND SYSTEM FOR AIR SEPARATION

BACKGROUND

The present invention relates to a process and to an installation for the separation of air by cryogenic distillation.

It is known to produce an air gas under pressure by vaporizing a pressurized liquid in an exchange line of an air separation unit by heat exchange with a compressed gas at a cryogenic temperature. Units of this type are known from FR-A-2 688 052, EP-A-0 644 388, EP-A-1 014 020 and patent application FR 03/01722.

The energy efficiency of the known devices is not excellent, as it is necessary to exhaust the heat influx associated with the cryogenic compression.

In addition, in the case of the diagrams such as that illustrated in FIG. 7 of U.S. Pat. No. 5,475,980, the entire turbine coupled to the cold booster is associated with an energy dissipation system (oil brake) incorporated onto the shaft of the machines and technologically limited to low power levels (of around 70 kW).

However, this type of process appears to be economically advantageous, in particular when the energy is of low value or available at low cost. It is therefore potentially advantageous to be able to exceed the technological limit of the oil brake incorporated on the shaft of the turbine/booster assembly.

SUMMARY

The invention includes methods and apparatus to achieve the desired result, as described, but is not limited to the various embodiments disclosed.

It is an object of the invention to propose an alternative system that allows process schemes to be carried out with a cold booster without an energy dissipation system incorporated into the booster turbine shaft, and therefore one that makes it possible to envisage using these schemes for more or less any size of air separation unit.

The present invention provides a process for the separation of air by cryogenic distillation in an installation comprising a double or triple air separation column, the column of which, operating at the higher pressure, operates at a pressure called the medium pressure, and an exchange line, in which process:

a) all the air is taken to a high pressure, at least 5 bar higher than the medium pressure, and purified at this high pressure;

b) a portion of the purified air stream is cooled in the exchange line and is then divided into two fractions;

c) each fraction is expanded in a turbine;

d) the intake pressure(s) of the two turbines is (are) at least 5 bar above the medium pressure;

e) the delivery pressure of at least one of the two turbines is substantially equal to the medium pressure;

f) at least one portion of the air expanded in at least one of the turbines is sent to the medium-pressure column of a double or triple column;

g) a cold booster mechanically coupled to one of the expansion turbines draws in air, which has been cooled in the exchange line, and delivers the air at a temperature above the intake temperature, and the fluid thus compressed is reintroduced into the exchange line in which at least a portion of the fluid condenses (or undergoes pseudo-condensation);

h) at least one pressurized liquid coming from one of the columns is vaporized (or undergoes pseudo-vaporization) in the exchange line at a vaporization temperature, and is characterized in that:

i) the turbine not coupled to the cold booster is provided with an energy dissipation device from among:

i) a mechanically coupled booster, other than the cold booster, followed by a cooler;

ii) an oil brake system; and iii) an electrical generator; and, optionally:

j) the intake temperature of the cold booster is close to the liquid vaporization (or pseudo-vaporization) temperature.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

The invention includes methods and apparatus for air separation by cryogenic distillation, as described above.

Figure 1:
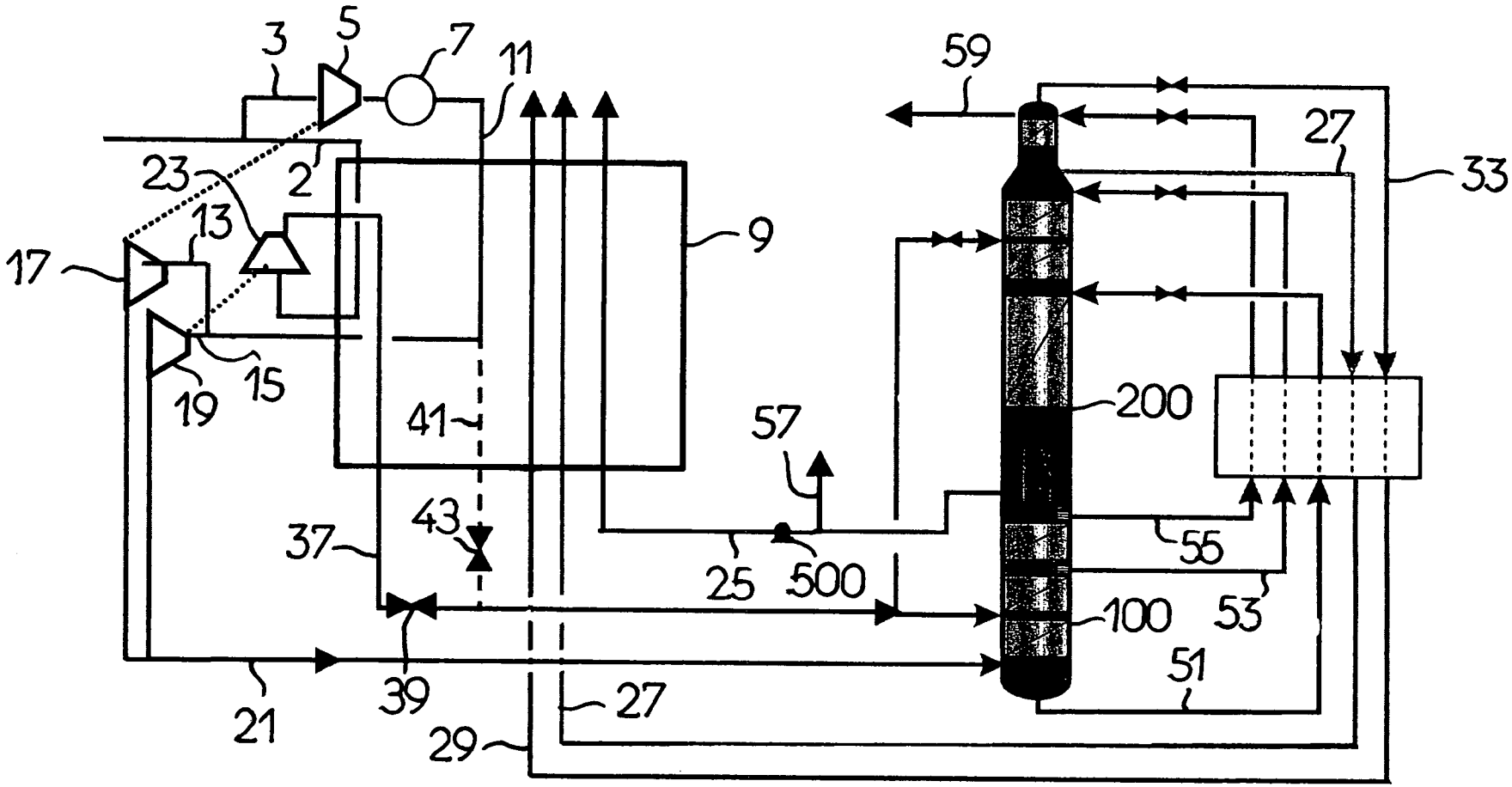
FIG. 1 illustrates a schematic representation of one embodiment, according to the present invention, of an air separation unit.
Figure 2:
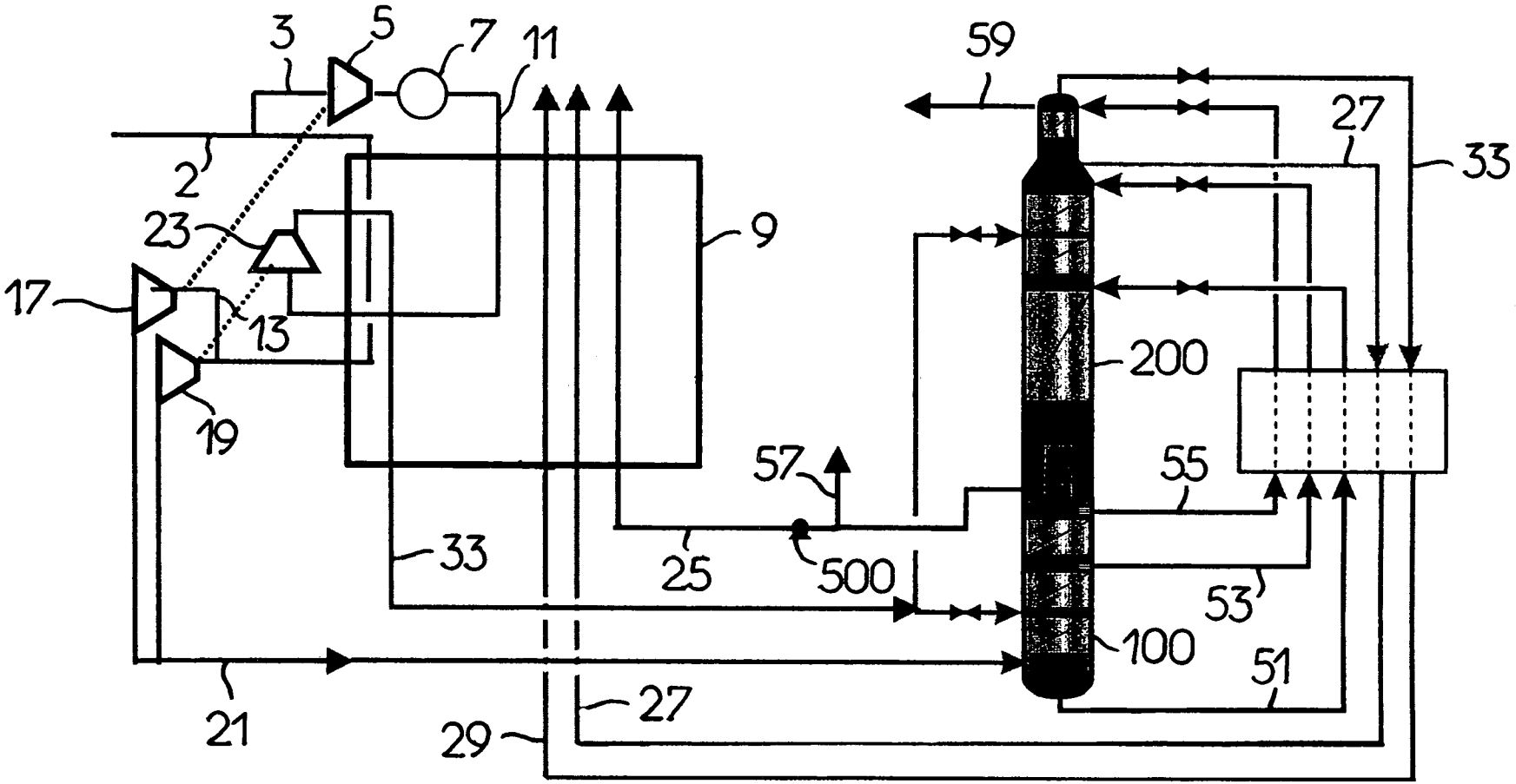
FIG. 2 illustrates a schematic representation of another embodiment, according to the present invention, of an air separation unit.
Figure 3:
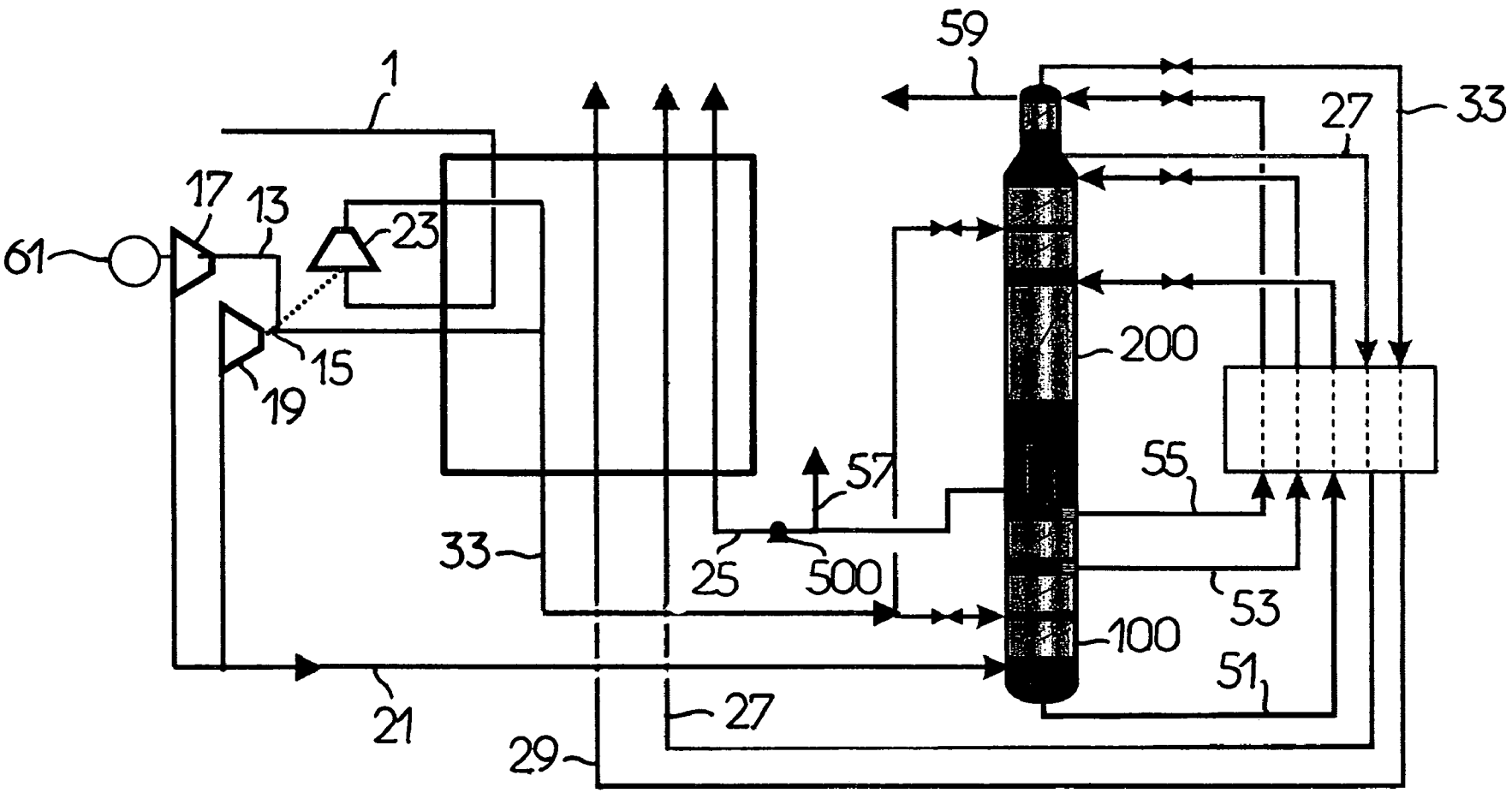
FIG. 3 illustrates a schematic representation of a third embodiment, according to the present invention, of an air separation unit.

According to other optional aspects of the invention:

the intake and delivery conditions of the two turbines are similar or identical in terms of pressure and temperature;

the air sent to the turbines is at the high pressure (FIG. 2);

the air sent to the turbines is at a pressure higher than the high pressure and comes from the cold booster and/or from the booster constituting the dissipation device or forming part of the latter (FIGS. 1 and 3);

all the air sent to the turbines comes from the booster constituting the dissipation device or forming part of the latter, and the air boosted in the cold booster continues to be cooled in the exchange line, is expanded, liquefied and sent to at least one column of the double column or triple column (FIG. 1);

a portion of the air boosted in the cold booster is sent to the turbines and the remainder continues to be cooled in the exchange line, is expanded, liquefied and sent to at least one column of the double column or the triple column (FIG. 3);

at least one portion of the air at the high pressure is boosted in the cold booster;

the air at high pressure is divided into at least two portions, one portion being boosted in the cold booster and another portion (the remainder) in the booster constituting the dissipation device or forming part of the latter (FIG. 1);

at least one portion of the air coming from the booster constituting the dissipation device or forming part of the latter is sent to the cold booster (FIG. 2);

at least one portion of the air boosted in the booster constituting the dissipation device or forming part of the latter is sent to the turbines (FIG. 1);

one portion of the air coming from the booster constituting the dissipation device or forming part of the latter is cooled against at least one liquid that vaporizes in the exchange line, is expanded, liquefied and sent to a column of the double or triple column;

at least one final product in liquid form is produced; and all the gaseous air intended for the columns of the double or triple column comes from the air expansion turbines.

Another aspect of the invention provides an air separation installation for separating air by cryogenic distillation, comprising:

a) a double or triple air separation column, the column of which that operates at the higher pressure operates at a pressure called the medium pressure;

b) an exchange line;

c) means for taking all the air to a high pressure, higher than the medium pressure, and means for purifying it at this high pressure;

d) means for sending a portion of the purified air stream into the exchange line in order to cool said stream, and means for dividing this cooled air into two fractions;

e) two turbines and means for sending a fraction of the air to each turbine;

f) means for sending at least one portion of the air expanded in at least one of the turbines to the medium-pressure column of the double or triple column;

g) a cold booster, means for sending air, preferably withdrawn at an intermediate point in the main exchange line, to the cold booster and means for sending air boosted in the cold booster into the main exchange line at an intermediate point upstream of the withdrawal point;

h) means for pressurizing at least one liquid coming from one of the columns, means for sending at least one pressurized liquid into the exchange line, and means for extracting a vaporized liquid from the exchange line; and i) the cold booster is coupled to one of the turbines, characterized in that the turbine not coupled to the cold booster is coupled to an energy dissipation means comprising:

i) a mechanically coupled booster, other than the cold booster, followed by a cooler;

ii) an oil brake system; and iii) an electrical generator.

According to other optional aspects, the installation comprises:

means for sending air to the turbines from the cold booster and/or from the booster constituting the energy dissipation means or forming part of the latter; and means for sending at least one portion of the air to be distilled into the booster constituting the energy dissipation means or forming part of the latter.

Preferably, the two boosters are connected in series or in parallel, and the turbines are connected in parallel.

Preferably, the intake temperature of the second booster is above the inlet temperature of the turbines.

An additional turbine, operating in parallel with the turbine of the first turbine/booster assembly and equipped with its own energy dissipation system will be used. Favorably, this system will be a booster followed by a water cooler installed in the warm part.

The expression "close in terms of pressure" means that the pressures differ by at most 5 bar, preferably at most 2 bar. The expression "close in terms of temperature" means that the temperature differ by at most 15° C., preferably at most 10° C.

A booster is a single-stage compressor.

All the pressures mentioned are absolute pressures.

The term "condensation" includes pseudo-condensation. The term "vaporization" includes pseudo-vaporization.

This invention is distinguished from U.S. Pat. No. 5,479,980 in the sense that, in FIG. 4 (optional turbine 9), the two turbines 8, 32 have very different intake pressures, the difference being at least 14 bar and in FIG. 5 the pressure difference is about 13 bar, and one turbine delivers at the low pressure, which is prejudicial in the case of pure oxygen.

The invention will be described in greater detail with reference to the figures in which:

FIGS. 1, 2 and 3 show an air separation unit according to the invention.

In FIG. 1, a stream of air at atmospheric pressure is compressed to about 15 bar in a main compressor (not illustrated). The air is then optionally cooled, before being purified so as to remove the impurities (this operation not being illustrated). The purified air is divided into two streams. One portion of the air 3 is sent to a booster 5 where it is boosted up to a pressure of between 17 and 20 bar and then the boosted air is cooled by a water cooler 7 before being sent to the warm end of the main exchange line 9 of the air separation unit. The boosted air 11 cools down to an intermediate temperature before leaving the exchange line and is divided into two fractions. One fraction 13 is sent into a turbine 17 and the other fraction 15 is sent into a turbine 19. The two turbines have the same intake temperature and pressure and the same delivery temperature and pressure, but it is of course possible for these temperatures and pressures to be close to one another rather than being identical. The two turbine-expanded streams are mixed together, to form a gaseous air stream 21 that is sent into the column system, as described with regard to FIG. 2. As a variant, the turbine 19 may be a blowing turbine delivering at the pressure of the low-pressure column.

Another portion 2 of the air at 15 bar, constituting the remainder of the air, is cooled in the exchange line down to an intermediate temperature above the intake temperature of the turbines 17, 19, compressed in a second booster 23 up to about 30 bar, and reintroduced into the exchange line 9 at a higher temperature, so as to continue to be cooled.

Thus, the air 37 at 30 bar liquefies in the exchange line and the liquid oxygen 25 vaporizes in the exchange line, the vaporization temperature of the liquid being close to the intake temperature of the second booster 23. The liquefied air leaves the exchange line and is sent into the column system.

A waste nitrogen stream 27 is warmed in the exchange line 9.

The first booster 5 is coupled to one of the turbines, 17 or 19, and the second booster 23 is coupled to the other turbine, 19 or 17.

The column system of an air separation unit is formed by a medium-pressure column 100 thermally coupled to a low-pressure column 200.

The medium-pressure column operates at a pressure of 5.5 bar, but it may operate at a higher pressure.

The gaseous air 21 coming from the two turbines 17, 19 is the stream sent into the bottom of the medium-pressure column 100.

The liquefied air 37 is expanded in the valve 39 and divided into two portions, one portion being sent to the medium-pressure column 100 and the other portion to the low-pressure column 200.

Rich liquid 51, lower lean liquid 53 and upper lean liquid 55 are sent from the medium-pressure column 100 into the low-pressure column 200 after expansion steps in valves and subcooling.

Liquid oxygen 57 and liquid nitrogen 59 are withdrawn as final products from the double column.

Liquid oxygen is pressurized by the pump 500 and sent, as pressurized liquid 25, into the exchange line 9. Other liquids, which may or may not be pressurized, may vaporize in the exchange line.

Gaseous nitrogen is optionally withdrawn from the medium-pressure column and also cools in the exchange line 9.

Nitrogen 33 is withdrawn from the top of the low-pressure column and is warmed in the exchange line, after having been used to subcool the reflux liquids.

Waste nitrogen 27 is withdrawn from a lower level of the low-pressure column and is warmed in the exchange line, after having been used to subcool the reflux liquids.

Optionally, the column may produce argon, by treating a stream withdrawn from the low-pressure column 200.

As a variant of FIG. 1, only one portion of the air boosted in the first booster is sent into the turbines 17, 19. The rest of the air 41 is liquefied at the outlet of the exchange line. The liquid is then expanded in a valve 43 and mixed with the liquid 30 expanded in the valve 39. The remainder of the figure is identical to that of FIG. 1.

In FIG. 2, an air stream at atmospheric pressure is compressed to 15 bar in a main compressor 1. The air is then optionally cooled and purified, in order to remove the impurities, and cooled. A first portion of the purified air is boosted in the first booster 5 up to a pressure of about 17 bar before being cooled by a water cooler 7.

On leaving the cooler 7, the air 11 is boosted in the second booster 23 up to about 30 bar before being cooled down to an intermediate temperature of the exchange line 9, close to the liquid oxygen vaporization temperature. The air at 30 bar is then reintroduced into the exchanger 9 at a higher temperature and is cooled by passing through the exchange line, and is liquefied. The air 33 is divided into two, expanded and sent into the two columns 100, 200.

The second portion 2 of the air at 15 bar is cooled in the exchange line down to a temperature below the intake temperature of the booster 23, leaves the exchange line and is divided into two. Each portion of the air is expanded in a turbine 17, 19 before being sent into the medium-pressure column 100.

The warm booster 5 is coupled to the turbine 17 and the cold booster 23 is coupled to the turbine 19.

In FIG. 2, the two turbines 17 and 19 are fed not with air coming from the warm booster but with air at the high pressure. The cold booster 23 boosts all the air coming from the warm booster 5, and this air is then liquefied. The inlet pressure of the turbines is therefore lower than in FIG. 1. The rest of FIG. 2 is identical to FIG. 1.

In FIG. 3, the warm booster 5 is omitted. All the air 1 is sent to the exchange line at a single pressure of 5 to 10 bar above the medium pressure.

This air is withdrawn from the exchange line at an intermediate temperature and all the air is boosted, at a temperature below ambient temperature, up to a pressure of 18 bar in the cold booster 23. Next, the boosted air is divided into two. One portion 33 continues to be cooled until reaching the cold end of the exchange line, is liquefied and is expanded, to be sent into at least one column of the column system 100, 200.

The rest of the air leaves the exchange line at an intermediate temperature below the intake temperature of the cold booster, is divided into two and sent into two turbines 17, 19 under the same, or similar, temperature and pressure conditions at the inlet and at the outlet. The stream joined with air expanded in the turbines 17, 19 is sent to the medium-pressure column and constitutes the sole gaseous air intake into the double column.

The cold booster 23 is coupled to the turbine 19 and the turbine 17 is coupled to an electrical generator 61, which may be replaced with an oil brake.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method which may be used for the separation of air by cryogenic distillation in a system of columns, said method comprising:

a) providing a system of columns comprising a double column or a triple column, wherein said column operating at the highest pressure is operating at a pressure called medium pressure;

b) providing an exchange line;

c) taking all the air to be distilled to a high pressure, wherein said high pressure is at least about 5 bar greater than said medium pressure;

d) purifying said air at said high pressure;

e) cooling at least a portion of said purified air in said exchange line, and dividing said purified air into a first and a second fraction;

f) expanding said first and said second fractions in at least one turbine, wherein:

1) said turbine has an intake pressure which is at least 5 bar greater than said medium pressure; and 2) at least one said turbine has a delivery pressure substantially equal to said medium pressure;

g) sending at least a portion of air from said turbine to a medium pressure column in said system of columns;

h) drawing cooled air from said exchange line with a cold booster, wherein said cold booster is mechanically coupled to at least one said turbine;

i) reintroducing compressed air from said cold booster to said exchange line, wherein:

1) said reintroduced air has temperature greater than an intake temperature of said cold booster; and 2) at least a portion of said reintroduced air condenses, or pseudo-condenses, in said exchange line;

i) vaporizing, or pseudo-vaporizing, at least one pressurized liquid from said columns, wherein said vaporizing, or pseudo-vaporizing, occurs in said exchange line at a vaporization temperature; and k) providing an energy dissipation device, wherein:

1) said energy dissipation device is provided to at least one turbine not coupled to said cold booster; and 2) said energy dissipation device comprises at least one member selected from the group consisting of:

i) a mechanically coupled booster, followed by a cooler, wherein said mechanically coupled booster is not said cold booster;

ii) an oil break system; and iii) an electrical generator, wherein two said turbines have substantially the same pressure and temperature conditions in terms of intake and delivery conditions.

2. The method of claim 1, wherein:

a) at least a portion of said air boosted in said cold booster is sent to said at least one turbine; and b) at least a portion of said air boosted in said cold booster continues to be cooled in said exchange line, and is then expanded, liquefied, and sent to said system of columns.

3. The method of claim 1, further comprising sending at least a portion of air from said dissipation device to said cold booster.

4. The method of claim 1, further comprising cooling at least a portion of air from said dissipation device against said liquid vaporizing in said exchange line and then expanding, liquefying and sending said air to said system of columns.

5. The method of claim 1, wherein all the air intended for said columns is from said turbines.

6. An apparatus which may be used for air separation by cryogenic distillation, said apparatus comprising:

a) at least one double or triple air separation column, wherein said column operating at the highest pressure is operating at a pressure called medium pressure;

b) at least one exchange line;

c)at least one pressurizing means which pressurizes all the air to be distilled to a high pressure;

d) at least one purifying means which purifies said air at said high pressure;

e) at least one cooling means which sends a portion of said purified air to said exchange line in order to cool said portion of purified air;

f) at least one dividing means which divides said cooled air into at least two fractions;

g) at least two turbines, wherein each said turbine comprises an inlet means which directs at least one said fraction to each said turbine;

h) at least one medium pressure column inlet means which sends at least one expanded portion of air from said turbine to a medium pressure column of said double or triple column;

i) at least one cold booster, wherein said cold booster is coupled to said turbine, and said cold booster comprises:

1) a cold booster inlet means which sends air from a first intermediate point on said exchange line to said cold booster; and 2) a cold booster outlet means which sends air from said cold booster back to a point upstream of said first intermediate point;

j) at least one pressurizing means which pressurizes at least one liquid from said columns;

k) at least one liquid injection means which injects said pressurized liquid into said exchange line;

l) at least one vaporized liquid withdraw means which extracts vaporized liquid from said exchange line; and m) at least one energy dissipation device, wherein:

1) said energy dissipation device is coupled to said turbine not coupled to said cold booster; and 2) said energy dissipation device comprises at least one member selected from the group consisting of:

i) a mechanically coupled booster, followed by a cooler, wherein said mechanically coupled booster is not said cold booster;

ii) an oil break system; and iii) an electrical generator, further comprising a turbine injection means which sends air from said cold booster or said energy dissipation device to said turbine.

7. An apparatus which may be used for air separation by cryogenic distillation, said apparatus comprising:

a) at least one double or triple air separation column, wherein said column operating at the highest pressure is operating at a pressure called medium pressure;

b) at least one exchange line;

c) at least one pressurizing means which pressurizes all the air to be distilled to a high pressure;

d) at least one purifying means which purifies said air at said high pressure;

e) at least one cooling means which sends a portion of said purified air to said exchange line in order to cool said portion of purified air;

f) at least one dividing means which divides said cooled air into at least two fractions;

g) at least two turbines, wherein each said turbine comprises an inlet means which directs at least one said fraction to each said turbine;

h) at least one medium pressure column inlet means which sends at least one expanded portion of air from said turbine to a medium pressure column of said double or triple column;

i) at least one cold booster, wherein said cold booster is coupled to said turbine, and said cold booster comprises:

1) a cold booster inlet means which sends air from a first intermediate point on said exchange line to said cold booster; and 2) a cold booster outlet means which sends air from said cold booster back to a point upstream of said first intermediate point;

j) at least one pressurizing means which pressurizes at least one liquid from said columns;

k) at least one liquid injection means which injects said pressurized liquid into said exchange line;

l) at least one vaporized liquid withdraw means which extracts vaporized liquid from said exchange line; and m) at least one energy dissipation device, wherein:

1) said energy dissipation device is coupled to said turbine not coupled to said cold booster; and 2) said energy dissipation device comprises at least one member selected from the group consisting of:

i) a mechanically coupled booster, followed by a cooler, wherein said mechanically coupled booster is not said cold booster;

ii) an oil break system; and iii) an electrical generator, wherein:

a) said cold booster is connected in parallel to said energy dissipation device; and b) said turbines are connected in parallel.

* * * * *

UNITED STATES PATENT AND TRADEMARK OFFICE

CERTIFICATE OF CORRECTION

PATENT NO. : 7,464,568 B2
APPLICATION NO. : 10/555765
DATED : December 16, 2008
INVENTOR(S) : Patrick Le Bot and Olivier De Cayeux It is certified that error appears in the above-identified patent and that said Letters Patent is hereby corrected as shown below:

In Column 6, line 48, replace "i)" with --j)--.

Signed and Sealed this

Thirteenth Day of April, 2010

David J. Kappos

David J. Kappos
*Director of the United States Patent and Trademark Office*